US009854888B2

(12) United States Patent
Nicholson

(10) Patent No.: US 9,854,888 B2
(45) Date of Patent: Jan. 2, 2018

(54) COMBINATION PICTURE FRAME AND JEWELRY BOX

(71) Applicant: Patrice Nicholson, Ansonia, CT (US)

(72) Inventor: Patrice Nicholson, Ansonia, CT (US)

( * ) Notice: Subject to any disclaimer, the term of this patent is extended or adjusted under 35 U.S.C. 154(b) by 0 days.

(21) Appl. No.: 14/525,700

(22) Filed: Oct. 28, 2014

(65) Prior Publication Data

US 2015/0113846 A1 Apr. 30, 2015

Related U.S. Application Data

(60) Provisional application No. 61/896,488, filed on Oct. 28, 2013.

(51) Int. Cl.

| | |
|---|---|
| ***A47B 67/00*** | (2006.01) |
| ***A45C 11/16*** | (2006.01) |
| ***A47G 1/06*** | (2006.01) |
| ***A47F 7/02*** | (2006.01) |

(52) U.S. Cl.

CPC ..... *A45C 11/16* (2013.01); *A47F 7/02* (2013.01); *A47G 1/06* (2013.01); *A47G 1/0616* (2013.01)

(58) Field of Classification Search

CPC ..... A47G 1/06; A47G 1/0616; A47G 1/143; G09F 1/12; A45C 11/16; A47F 7/02; A47F 7/03

USPC ..... 40/723, 724; 206/566, 6.1, 752–754

See application file for complete search history.

(56) References Cited

U.S. PATENT DOCUMENTS

| | | | | | |
|---|---|---|---|---|---|
| 1,260,912 | A | | 3/1918 | Kisch | |
| 1,389,595 | A | * | 9/1921 | Phillips | 190/13 E |
| 1,432,851 | A | * | 10/1922 | Hamlin | 190/13 D |
| 1,436,615 | A | * | 11/1922 | Urbanek | G09F 15/0012 40/507 |
| 2,186,643 | A | * | 1/1940 | Kaplan | A47G 1/06 312/204 |
| 2,501,694 | A | | 3/1950 | Ruffin | |
| 3,039,217 | A | * | 6/1962 | Stefanakis | A47G 1/00 312/224 |
| 3,209,903 | A | * | 10/1965 | Shiffman | 206/752 |
| 3,930,702 | A | * | 1/1976 | Pichowicz | 312/245 |
| 4,304,447 | A | * | 12/1981 | Ellwood et al. | 312/204 |
| 4,324,446 | A | * | 4/1982 | LeSage | 312/245 |
| 4,413,736 | A | * | 11/1983 | Nibling | 206/566 |
| 4,630,386 | A | * | 12/1986 | Wilson | 40/734 |
| 4,848,586 | A | * | 7/1989 | Jasik | 206/566 |

(Continued)

*Primary Examiner* — Shin Kim

(74) *Attorney, Agent, or Firm* — Global Intellectual Property Agency, LLC; Daniel Enea

(57) ABSTRACT

Disclosed is a combination picture frame and jewelry box. The device includes a first section that is hingedly attached to a second section. In one embodiment, the first section and the second section may resemble a steamer trunk. The first and second section can be manipulated into an open position and a closed position. The first and second section can remain securely closed in a closed position via a locking mechanism, which includes a keyhole that is disposed in the first section. The first section further includes a picture frame, while the second section includes a mirror. Each of the first and second sections includes a defined interior volume that is compartmentalized to organize various jewelry items such as rings, earrings, bracelets, necklaces, and the like. In this way, the present invention provides a jewelry box with multiple features to reduce clutter and to increase versatility.

11 Claims, 3 Drawing Sheets

(56) References Cited

U.S. PATENT DOCUMENTS

| | | | | | |
|---|---|---|---|---|---|
| 4,978,001 | A * | 12/1990 | Nelson | 206/748 |
| 5,141,300 | A * | 8/1992 | Ciesla | 312/204 |
| D329,565 | S * | 9/1992 | Kane et al. | D6/559 |
| 5,209,344 | A * | 5/1993 | Smith | 206/6.1 |
| 5,511,873 | A * | 4/1996 | Mech | 312/227 |
| 5,758,936 | A * | 6/1998 | Baughan | 312/245 |
| 5,979,661 | A * | 11/1999 | Sherman et al. | 206/754 |
| 6,012,789 | A * | 1/2000 | Lai | 312/225 |
| 6,164,442 | A * | 12/2000 | Stravitz | 206/233 |
| 6,349,494 | B1 * | 2/2002 | Haggarty-Robbins | 40/723 |
| 6,553,704 | B1 * | 4/2003 | Pigg | 40/734 |
| 6,874,624 | B2 * | 4/2005 | Redzisz | 206/278 |
| 6,926,136 | B1 * | 8/2005 | Lynch-Bass | 206/6.1 |
| 7,146,759 | B2 * | 12/2006 | Bell | 40/734 |
| 7,182,416 | B1 * | 2/2007 | Greiner | 312/321.5 |
| 7,266,920 | B2 * | 9/2007 | Kao | 40/800 |
| 7,481,014 | B2 * | 1/2009 | Milburn | 40/724 |
| 7,806,255 | B1 | 10/2010 | Staver | |
| 7,806,284 | B2 * | 10/2010 | Mangano | 220/4.27 |
| D676,259 | S | 2/2013 | Lu | |
| 8,869,440 | B2 * | 10/2014 | Lyons et al. | 40/649 |
| 2004/0178116 | A1 * | 9/2004 | Daetweiler et al. | 206/747 |
| 2005/0093405 | A1 * | 5/2005 | Greiner | 312/321.5 |
| 2007/0084743 | A1 | 4/2007 | Chu | |
| 2009/0026158 | A1 * | 1/2009 | Mangano | 211/85.2 |
| 2012/0068582 | A1 * | 3/2012 | Elderkin et al. | 312/7.1 |
| 2013/0069510 | A1 * | 3/2013 | Wexler | 312/309 |
| 2014/0033587 | A1 * | 2/2014 | Mazak et al. | 40/767 |
| 2014/0263116 | A1 * | 9/2014 | Wojciechowski | 211/85.2 |
| 2014/0346939 | A1 * | 11/2014 | Rickman | 312/334.1 |

* cited by examiner

COMBINATION PICTURE FRAME AND JEWELRY BOX

CROSS REFERENCE TO RELATED APPLICATION

This application claims the benefit of U.S. Provisional Application No. 61/896,488 filed on Oct. 28, 2013. The above identified patent application is herein incorporated by reference in its entirety to provide continuity of disclosure.

BACKGROUND OF THE INVENTION

Field of the Invention

The present invention relates to a jewelry box. More specifically, the present invention pertains to an improved jewelry box with a picture frame and a mirror attached thereto, and in one embodiment, the jewelry box comprises a steamer trunk appearance.

Properly storing jewelry in an organized manner is a tedious and arduous task that is time consuming for many individuals, particularly those with numerous and multiple types of jewelry, including rings, earrings, bracelets, and necklaces, among others. However, properly storing jewelry is important to ensure that jewelry pieces are not misplaced or damaged. While several different types of jewelry boxes and chests are known, most of these jewelry boxes and chests are not multifunctional, and do not comprise features that allow the user to consolidate various items that are generally placed on a vanity table, such as picture frames, mirrors, and the like.

While some types of jewelry boxes and chests are designed to be multifunctional, such jewelry boxes are often visually unappealing and clash with the room décor, and may detract from the appearance of the room in which it is located. Thus, a jewelry box that blends well with the décor of a room while serving multiple uses and purposes is desired.

The present invention provides a combination picture frame and jewelry box. The jewelry box comprises a first section and a second section, each section comprises an interior volume for storing various jewelry items therein. The first and second sections are hingedly attached so that they can be opened to provide access to the interior volume or closed and locked via a locking mechanism, which includes a keyhole. The first section further comprises a picture frame permanently attached at the front of the exterior surface thereof. The picture frame comprises a slot disposed along the upper edge thereof, so that the user can interchange the picture held within the frame. The second section further comprises a mirror attached at the front of the exterior surface thereof. The mirror is dimensioned so that it does not extend beyond the second section.

The interior volume of the first section is adapted to hold a plurality of necklaces therein. As such, the interior volume of the first section includes hooks for hanging necklaces thereon. Additionally, the first section may include a pouch and a drawer for storing additional items. The interior volume of the second section is compartmentalized into a ring section, an earring section, and a drawer section. The ring section comprises a plurality of cushioned strips that are disposed adjacent to each other to form gaps therein, in which rings can be held. The earring section comprises one or more brackets each having a scalloped upper edge that is adapted to hold a plurality of earrings thereon. The drawer section comprises drawers for holding miscellaneous jewelry items such as bracelets and anklets therein. The drawers may differ in dimension and shape so as to provide versatility to the user. In this way, the user can store and organize various types of jewelry in the jewelry box of the present invention, wherein the same can be used to display photographs and provide a mirror.

DESCRIPTION OF THE PRIOR ART

Devices have been disclosed in the prior art that relate to jewelry boxes and display cases. These include devices that have been patented and published in patent application publications. Some of these devices disclose ornamental boxes with hingedly attached lids for storing jewelry or other items therein. Other devices disclose jewelry boxes with a picture frame attached thereto. These devices, however, do not disclose a combination picture frame and jewelry box having multiple compartments and a mirror attached thereto. The foregoing is a list of devices deemed most relevant to the present disclosure, which are herein described for the purposes of highlighting and differentiating the unique aspects of the present invention, and further highlighting the drawbacks existing in the prior art.

Specifically, U.S. Pat. No. 1,260,912 to Kisch and U.S. Pat. No. 2,501,694 to Ruffin disclose ornamental boxes with lids. The box comprises an open top, side walls, a bottom wall, defining an interior volume. The interior volume may comprise a plurality of trays for holding and organizing receptacles therein. The lid can open and close via hinges, providing access to the interior volume. These devices, however, are directed toward boxes for storing small items and do not comprise a picture frame and a mirror thereon. The front of the jewelry box of the present invention comprises a picture frame thereon, and the rear of the jewelry box comprises a mirror thereon. Thus, the present invention comprises a jewelry box with additional functionality compared to conventional jewelry boxes.

Similarly, U.S. Pat. No. 4,413,736 to Nibling discloses a jewelry box comprising a removable frame. The jewelry box comprises a front section that is hingedly attached to a back section. Each of the front section and the back section comprises a recessed portion with a plurality of hooks thereon. Each of the hooks is adapted to hold one necklace so that the necklace is prevented from becoming entangled with other necklaces stored therein. The front section comprises a removable picture frame thereon. While the device of Nibling discloses a jewelry box with a picture frame, the device of Nibling is limited in that the jewelry box is not adapted to store rings, bracelets, and earrings in separate compartments. The present invention discloses a jewelry box with separate compartments for storing various types of jewelry. Additionally, the jewelry box of the present invention comprises a picture frame on one side, and a mirror on the opposite side thereof.

U.S. Published Patent Application Number 2007/0084743 to Chu discloses a combination picture frame and a storage box, comprising a box with a back wall, side walls, a bottom wall, and a top wall, leaving the front open and defining a perimeter therearound. The perimeter comprises a lip that is adapted to support a backing sheet and a picture frame thereon. Because the picture frame is mounted to the front of the box, the hollow interior of the box can be used to store items therein. Unlike the present invention however, the interior of the box is not adapted to hold jewelry items therein. The box does not comprise separate compartments, hooks, or drawers that can store different types of jewelry.

U.S. Pat. No. 7,806,255 to Stayer discloses a jewelry display comprising a front section and a rear section. The front section comprises a mirror and a screen that can be opened to retrieve items stored in the rear section, which comprises a plurality of hooks for holding necklaces. The mirror and the screen are removably attached to the front section by means of magnets. The front section may be hingedly attached to the rear section. The Stayer device, however, does not comprise drawers, and does not comprise a picture frame for displaying photographs or paintings thereon.

Finally, U.S. Design Pat. No. D676,259 to Lu discloses a jewelry box having a digital photo frame on the top wall thereof. The top wall is slanted so that the user can view the pictures displayed in the frame. The top wall is hingedly attached to the jewelry box to provide access to the interior. The front wall comprises a pair of drawers for storing small items therein. The device of Lu, however, does not disclose two sections, wherein each of the sections is adapted to store jewelry therein. The present invention comprises a first section and a second section that are substantially equal in size and dimension, and wherein both sections comprise multiple compartments for storing jewelry therein.

The devices disclosed in the prior art have several known drawbacks. These devices are limited in that they do not comprise multiple compartments for holding various types of jewelry therein. Additionally, the prior art devices fail to disclose a jewelry box with a picture frame on one side and a mirror on the opposite side. The present invention overcomes these limitations by disclosing a jewelry box with a first section that is hingedly attached to a second section, the first section having a picture frame thereon, and the second section having a mirror thereon. Each of the first and second sections comprises a plurality of compartments therein for storing various types of jewelry separate and organized.

It is therefore submitted that the present invention is substantially divergent in design elements from the prior art, and consequently it is clear that there is a need in the art for an improvement to jewelry boxes and display cases. In this regard, the instant invention substantially fulfills these needs.

SUMMARY OF THE INVENTION

In view of the foregoing disadvantages inherent in the known types of jewelry boxes and display cases now present in the prior art, the present invention provides a new and improved combination picture frame and jewelry box wherein the same can be utilized for displaying photographs and storing jewelry in an organized manner.

It is therefore an object of the invention to provide a new and improved combination picture frame and jewelry box that has all of the advantages of the prior art and none of the disadvantages.

Another object of the present invention is to provide a new and improved combination picture frame and jewelry box having multiple compartments to organize various jewelry such as earrings, rings, necklaces, bracelets, and the like.

Yet another object of the present invention is to provide a new and improved combination picture frame and jewelry box having a picture frame on the front side thereof.

Still yet another object of the present invention is to provide a new and improved combination picture frame and jewelry box having a mirror on the rear side thereof.

Still yet another object of the present invention is to provide a new and improved combination picture frame and jewelry box having an appearance of a steamer trunk.

Still yet another object of the present invention is to provide a new and improved combination picture frame and jewelry box having a locking mechanism to store jewelry in a secure manner.

Still yet another object of the present invention is to provide a new and improved combination picture frame and jewelry box wherein the device may be readily fabricated from materials that permit relative economy and are commensurate with durability.

Other objects, features, and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein the numeral annotations are provided throughout.

DETAILED DESCRIPTION OF THE INVENTION

Figure 1:
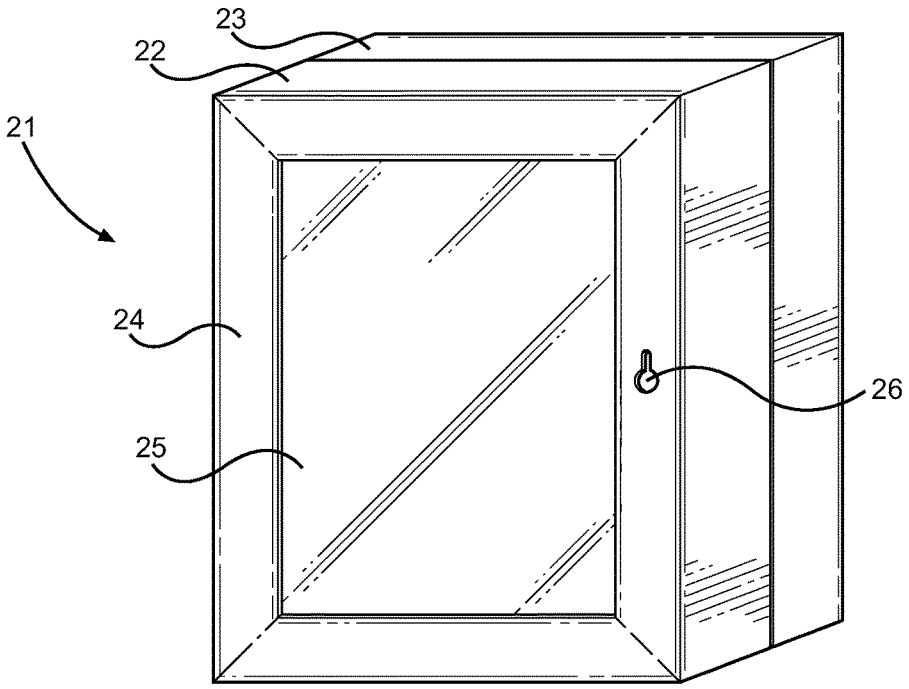
FIG. 1 shows a front perspective view of the present invention.

References are made herein to the attached drawings. Like reference numerals are used throughout the drawings to depict like or similar elements of the combination picture frame and jewelry box. For the purposes of presenting a brief and clear description of the present invention, the preferred embodiment will be discussed as used to display photographs and store jewelry in an organized manner. The figures are intended for representative purposes only and should not be considered to be limiting in any respect.

Figure 2:
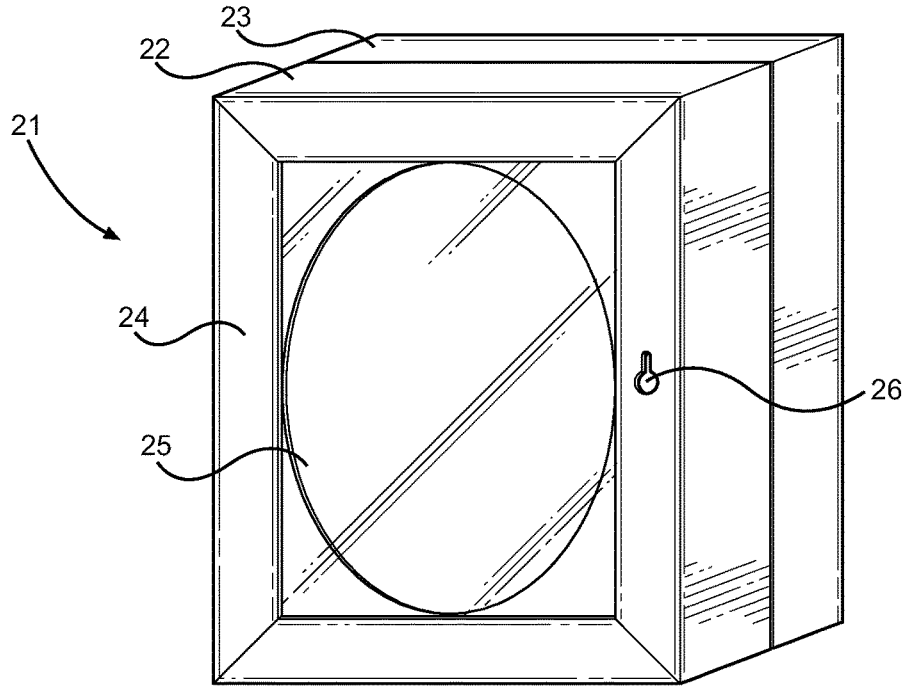
FIG. 2 shows a front perspective view of another embodiment of the present invention.

Referring now to FIGS. 1 and 2, there are shown front perspective views of exemplary embodiments of the present invention. The present invention comprises a jewelry box 21 having a first section 22 and a second section 23. The first section 22 is hingedly attached to the second section 23 so that the first and second sections 22, 23 can open and close. Each of the first and second sections 22, 23 are substantially rectangular in shape and comprises a defined interior volume therein. The interior volume of the first section 22 is defined by a front wall, a top wall, a bottom wall, and side walls, leaving the back wall open. Conversely, the interior volume of the second section 23 is defined by a back wall, a top wall, a bottom wall, and side walls, leaving the front wall open. Accordingly, the first and second sections 22, 23 are mirror images of each other. Thus, the first and second sections 22, 23 are substantially equal in dimension and shape so that each of the sides of the sections 22, 23 are level and contiguous to form a substantially unitary structure when in a closed configuration.

The first section 22 comprise a picture frame 24 permanently attached thereto via fasteners or adhesives. Alternatively, the picture frame 24 may be integral to the first section 22. The picture frame 24 preferably spans the entire front side of the exterior surface of the first section 22, but does not extend beyond the peripheral edges of the first section 22. The opening 25 of the picture frame 24 may be rectangular as shown in FIG. 1, or oval as shown in FIG. 2. The opening 25 may comprise a glass plate so as to protect a photograph or a picture in the frame 24. The picture frame 24 comprises a keyhole 26, which is adapted to receive a key therein. The keyhole 26 may be engaged to actuate a locking mechanism. The locking mechanism allows the first section 22 and the second section 23 to remain securely closed to prevent access to the interior volume therein.

Preferably, the exemplary embodiments of the present jewelry box 11 comprises the appearance of a steamer trunk. Accordingly, it is contemplated that the jewelry box 11 may be composed of wood or other suitable material with a walnut, oak, cherry, or mahogany finish. Alternatively, the jewelry box 11 may be composed of metal, glass, hard plastic, or other suitable materials. Additionally, the jewelry box may comprise leather trimmings around the edge and brass studs or buttons thereon.

Figure 3:
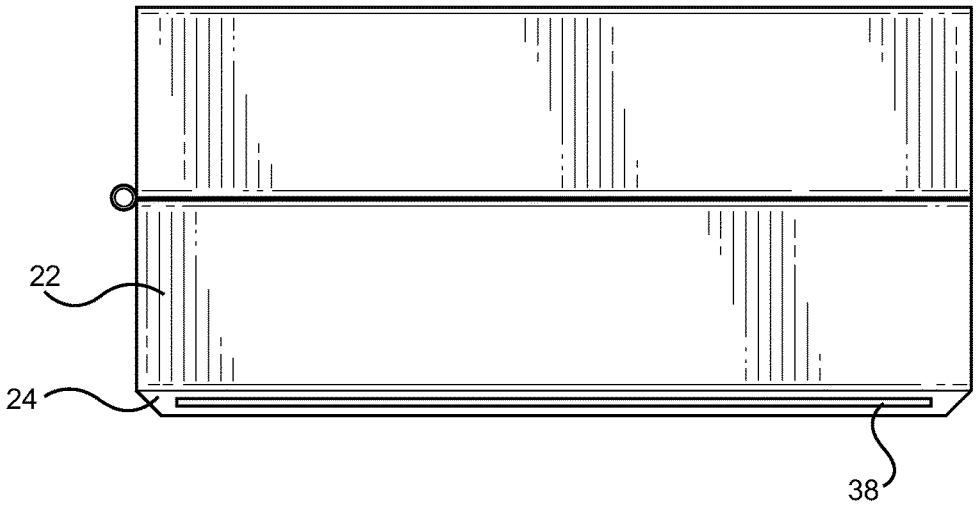
FIG. 3 shows a top plan view of the present invention.

Referring now to FIG. 3, there is shown a top plan view of the present invention. As described above, the picture frame 24 is attached to the first section 22 of the jewelry box. The picture frame 24 comprises an elongated slot 38 on the upper end thereof, so as to allow the user to slide a photograph and the glass plate in and out of the frame. In this way, the user can replace the photograph in the picture frame 24 as often as desired.

Figure 4:
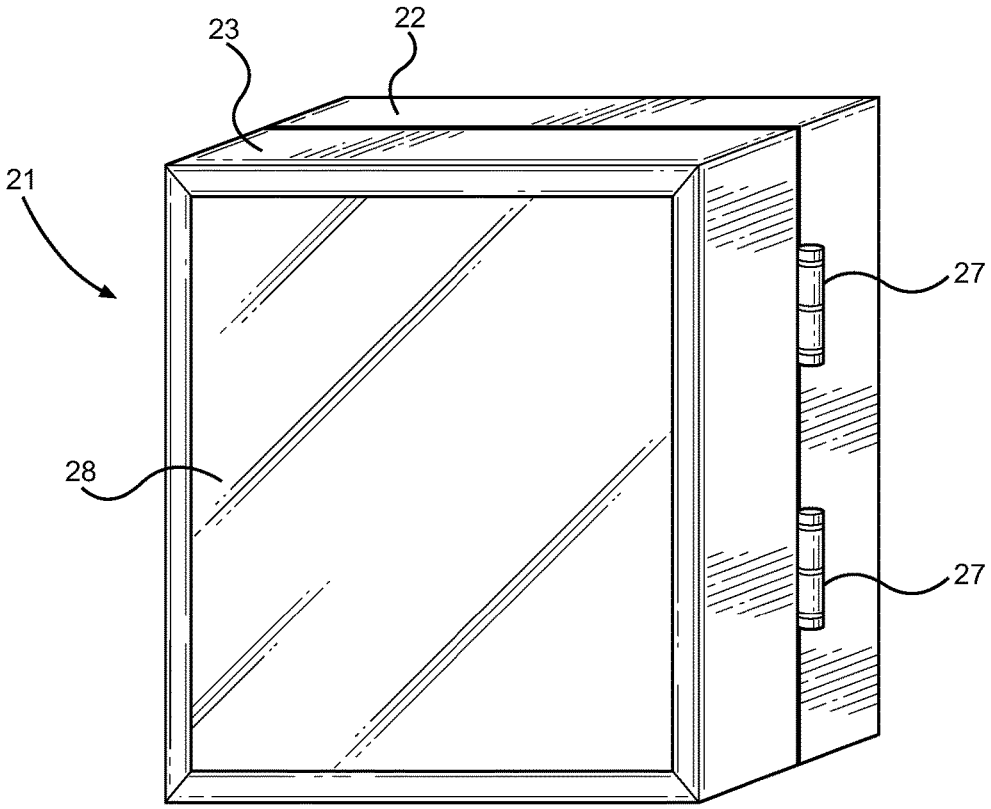
FIG. 4 shows a rear perspective view of the present invention.

Referring now to FIG. 4, there is shown a rear perspective view of the jewelry box 21 of the present invention. The first section 22 is attached to the second section 23 via hinges 27 vertically disposed along a longitudinal edge thereof. The second section 23 comprises a mirror 28 thereon. It is contemplated that the mirror 28 is permanetly affixed to the front side of the exterior of the second section 23 via strong adhesives or other suitable means. Preferably, the mirror 28 is dimensioned so that it spans the entire rear side of the second section 23 at the exterior thereof, but does not extend beyond the rear side of the second section 23. Accordingly, the mirror 28 is substantially rectangular in shape, but may comprise other shapes such as oval or circle in alternate embodiments. Additionally, the mirror 28 may comprise a beveled edge as depicted in FIG. 4, or comprise a flat edge, a pencil edge, a convex edge, or the like.

Figure 5:
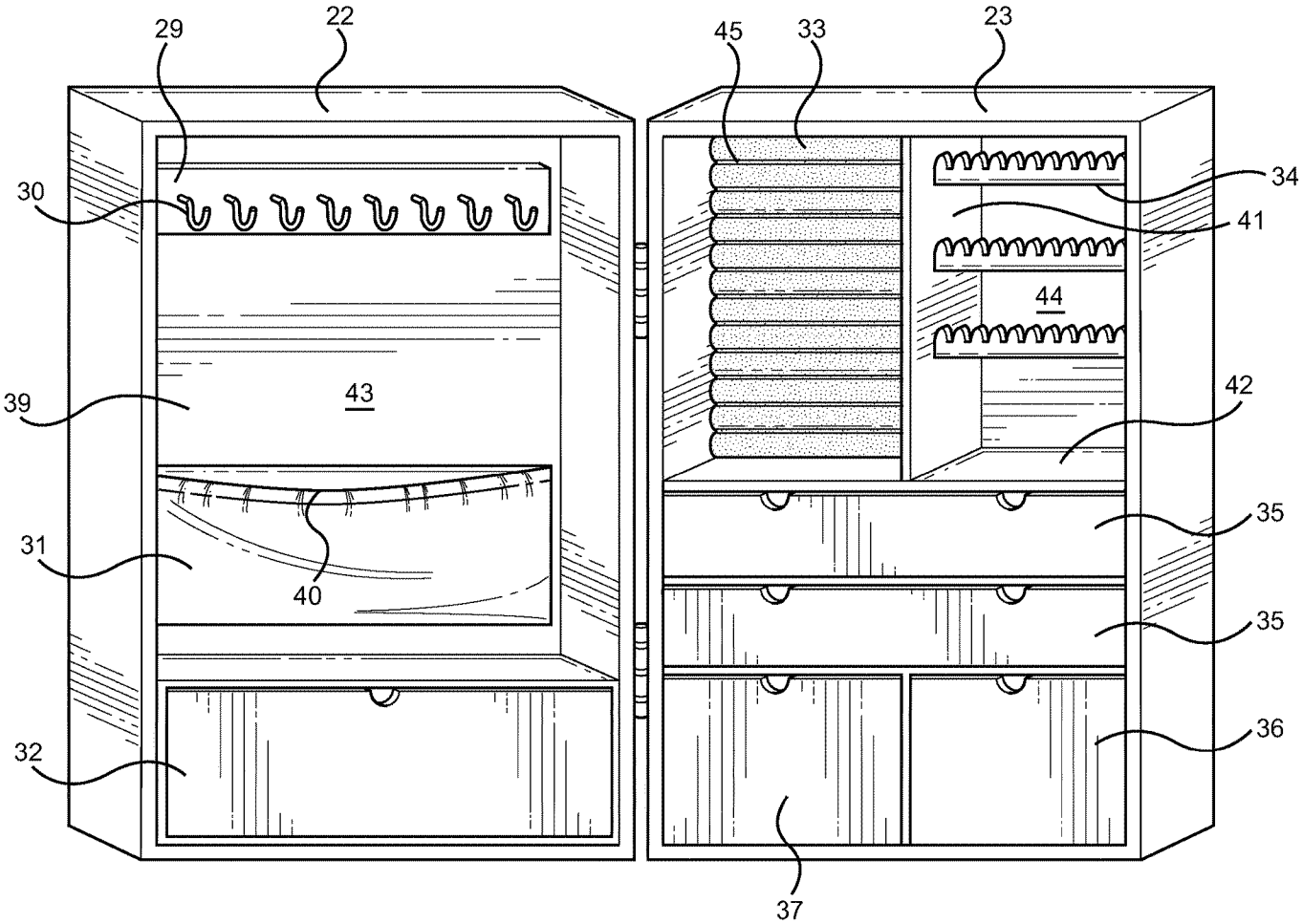
FIG. 5 shows an interior view of the present invention in an open configuration.

Referring now to FIG. 5, there is shown an interior view of the present invention in an open configuration. The first section 22 of the jewelry box comprises an interior volume 39. The interior volume 39 comprises an interior surface 43, which may be lined with velvet or other padded or soft material. The interior surface 43 comprises a rectangular hook support 29 attached thereto via fasteners such as nails or screws. The hook support 29 is disposed horizontally and extends between opposing side walls of the first section 22. The hook support 29 comprises a plurality of hooks 30 arranged in a linear configuration. The hooks 30 may be attached by means of fasteners or adhesives. Each of the hooks 30 extends outward from the hook support 29 so that it is adapted to hold a necklace thereon.

The hooks 30 are separated at regular intervals so that the necklaces are prevented from becoming entangled. The interior surface 43 further comprises a pouch 31 having an open upper end, wherein the pouch 31 is disposed below the hook support 29. The side ends and the bottom end of the pouch 31 may be sewn to the interior surface 43. The hook support 29 and the pouch 31 are separated by a space so that the bottom portion of the low-hanging necklaces can be inserted into the open upper end of the pouch 31 to prevent the bottom portion of the necklaces from dragging. The pouch 31 comprises an elastic closure 40 so that the necklaces can be secured in the pouch 31.

The interior volume 39 further comprises a shelf and a drawer 32 directly therebelow. The drawer 32 comprises an interior volume defined by a bottom wall and upstanding side walls, front wall, and back wall extending therefrom, leaving the top open. The shelf may be utilized to rest various items thereon while covering the open top portion of the drawer 32 when the drawer 32 is in a closed configuration. The drawer 32 is dimensioned so that the height of the side walls, the front wall, and the back wall is slightly less than the distance between the shelf and the bottom wall of the first section 22. In this way, the drawer 32 can slide in and out. The drawer 32 further comprises a fabric lining along the interior thereof, and a centralized cutout or handle on the upper end of the front wall to facilitate opening and closing of the drawer 32.

The second section 23 of the jewelry box also comprises an interior volume having an interior surface 44, which may be covered with velvet or other suitable material. The interior volume of the second section 23 comprises a vertical dividing wall 41 that is perpendicular to a horizontal dividing wall 42. The dividing walls 41, 42 define a ring section, an earring section, and a drawer section. The ring section comprises ring support cushions 33 comprising a plurality of elongated strips of cushion or foam disposed in a linear configuration, creating gaps or grooves 45 therebetween in which rings are held.

The earring section comprises a plurality or earring holders 34 having a bracket with a scalloped upper edge and a straight lower edge. The scalloped upper edge comprises a plurality of crests and troughs in which an end of an earring can be held. Each of the earring holders 34 are separated at regular intervals so that earrings on the holders 34 of an upper row do not contact the earring on the holders 34 of a lower row.

The drawer section comprises at least one bracelet drawer 35, a bangle drawer 36, and an accessory drawer 37. The drawers are adapted to slide out and are separated by means of shelves or additional dividing walls therebetween. Each of the drawers comprise an interior volume defined by a bottom wall and upstanding side walls, front wall, and back wall extending therefrom, leaving the top open. In the illustrated embodiment, the height of each of the side walls, front wall, and back wall of the bracelet drawers 35 may be less than the height of the side walls, front wall, and back wall of the bangle drawer 36 and the accessory drawer 37. Each of the drawers further comprise a substantially U-shaped cutout on the front wall at the upper end thereof. The cutout allows a user to better grip the drawer via his or her fingertip when opening and closing the drawers 35, 36, 37. The interior volume of the drawers 35, 36, 37 may be lined with velvet or other suitable material so that the jewelry contained therein is prevented from scratching.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above descriptions then, it is to be realized that the optimum dimensional relationships for the parts of the invention, to include variations in size, materials, shape, form, function, and manner of operation, assembly and use, are deemed readily apparent and obvious to one skilled in the art, and all equivalent relationships to those illustrated in the drawings and described in the specifications are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A jewelry box, comprising:

a first section including a front wall, a plurality of sidewalls, a first open end, and an interior volume, the first open end providing access to the interior volume of the first section;

a second section including a rear wall, a plurality of sidewalls, a second open end, and an interior volume, the second open end providing access to the interior volume of the second section;

the first section hingedly connected to the second section for selectively separating the first section from the second section to provide access to the first open end and the second open end;

wherein the front wall opposes the rear wall;

a picture frame disposed on an exterior surface of the front wall; and a mirror disposed on an exterior surface of the rear wall.

2. The jewelry box of claim 1, wherein the picture frame comprises a slot thereon for receiving a picture therethrough.

3. The jewelry box of claim 1, further comprising a locking mechanism including a keyhole disposed on the first section, the locking mechanism configured to secure the first section to the second section in a closed position.

4. The jewelry box of claim 1, wherein the interior volume of the first section comprises:

an interior surface including a padded material;

a hook support disposed horizontally on an upper end of an interior surface of the front wall, the hook support including a plurality of hooks extending outwardly from the interior surface of the front wall, the plurality of hooks arranged in a linear configuration.

5. The jewelry box of claim 4, further comprising:

a drawer disposed an a lower end of the interior surface of the front wall; and a pouch disposed between the hook support and the drawer, the pouch including an elastic closure configured to receive and secure items within the pouch.

6. The jewelry box of claim 5, wherein the drawer extends outwardly from a lower end of the interior surface of the front wall, the drawer including a handle and an interior volume having a fabric lining.

7. The jewelry box of claim 1, wherein the interior volume of the second section comprises:

ring support cushions disposed vertically along an interior surface of an upper end of the rear wall, the ring support cushions including a plurality of elongated strip cushions disposed in a linear configuration, creating gaps therebetween, each gap configured to receive and retain a ring therein;

earring holders disposed horizontally along an upper end of the rear wall, the earring holders including a bracket having a scalloped upper edge and a straight lower edge, the scalloped upper edge including a plurality of crests and a plurality of troughs;

wherein the ring support cushions are separated from the earring holders by a vertically dividing wall extending outwardly from the interior surface of the rear wall.

8. The jewelry box of claim 7, wherein the interior volume of the second section further comprises a plurality of drawers, extending outwardly from the interior surface of the rear wall, each including a cut-out and an interior volume having a fabric lining; wherein the plurality of drawers are separated from the ring support cushions and earring holders by a horizontally dividing wall extending outwardly from the interior surface of the rear wall.

9. The jewelry box of claim 8, wherein the plurality of drawers include a first drawer, a second drawer, a third drawer, and a fourth drawer;

wherein the first drawer and second drawer are equal in size; and wherein the second and third drawer are equal in size.

10. The jewelry box of claim 1, wherein the picture frame spans the entire exterior surface of the front wall.

11. The jewelry box of claim 1, wherein the mirror spans the entire exterior surface of the rear wall.

* * * * *